US005957288A

United States Patent [19]

Campbell

[11] Patent Number: 5,957,288

[45] Date of Patent: Sep. 28, 1999

[54] DIVIDER PANEL FOR STACKED CANS

[75] Inventor: Geoffrey Campbell, Bristol, United Kingdom

[73] Assignee: Riverwood International Corporation, Atlanta, Ga.

[21] Appl. No.: 08/793,125

[22] PCT Filed: Aug. 9, 1995

[86] PCT No.: PCT/GB95/01876

§ 371 Date: May 27, 1997

§ 102(e) Date: May 27, 1997

[87] PCT Pub. No.: WO96/05120

PCT Pub. Date: Feb. 22, 1996

[30] Foreign Application Priority Data

Aug. 17, 1994 [GB] United Kingdom ..... 9416623
Mar. 22, 1995 [GB] United Kingdom ..... 9505788

[51] Int. Cl.[6] ..... B65D 75/00

[52] U.S. Cl. ..... 206/430; 206/427

[58] Field of Search ..... 206/150, 153, 206/158, 192, 427, 430, 821; 53/445, 447

[56] References Cited

U.S. PATENT DOCUMENTS 3,224,575 12/1965 Whiteford .
3,383,827 5/1968 Schaich .
3,784,002 1/1974 Owen .
4,896,774 1/1990 Hammett et al. .
5,535,879 7/1996 Appleton .
5,551,566 9/1996 Sutherland .
5,755,324 5/1998 Campbell .

*Primary Examiner*—David T. Fidei
*Attorney, Agent, or Firm*—Womble Carlyle Sandridge & Rice, PLLC

[57] ABSTRACT

A divider panel for stacked cans is disclosed. The divider panel has an elongate paperboard strip (10) which includes a plurality of divider pads (12), each divider pad providing two rows of can seats (11) defined therein for being disposed between two layers of vertically stacked cans. The divider pads are connected along their ends to adjacent ones of the divider pads along perforated lines (13) to assist in separating the divider pads from one another as desired. The use of the elongate divider panel of this invention allows for lower operating speeds in placing the divider panel on a generally continuous lower layer of cans prior to placing the upper layer of cans thereon as the divider panel and the cans move along a path of travel on a packaging machine when compared to sequentially placing one of a series of separate divider pads between the pairs of cans otherwise being moved along the path of travel on the packaging machine at a relatively faster rate of speed. The divider panel of this invention can be used with a variety of arrays of cans.

10 Claims, 3 Drawing Sheets

DIVIDER PANEL FOR STACKED CANS

CROSS REFERENCE TO A RELATED APPLICATION

This application claims the benefit of international application Ser. No. PCT/GB95/01876, filed Aug. 9, 1995.

BACKGROUND OF THE INVENTION

This invention relates to divider pads for use between two or more levels of cans stacked one row above the other. Such cans can contain a variety of materials or articles such as beverages or food. Multipacks of cans are quite common in which two levels of cans are provided with a divider pad between the levels so as to prevent can to can contact. A paperboard carton then encloses all of the cans.

SUMMARY OF THE INVENTION

The present invention includes a paperboard divider arrangement comprising a number of divider pads defining a plurality of seat areas, each of which in use is disposed between an upper can and a lower can stacked one on top of the other, said divider pads being joined together end to end.

Preferably each divider pad is separated from the next by lines of weakening such as perforations.

In one embodiment the arrangement comprises an independent strip comprising a number of divider pads for accommodating a predetermined number of cans along its length. Conveniently the predetermined number of cans, and thus seat areas, is divisible by 2, 3 and 4.

In another embodiment a number of said pads are attached to each other end to end so as to be foldable in a concertina fashion, and in yet another embodiment a number of divider pads are provided on a roll.

A preferred feature is that the divider pads provide seats for accommodating two or more rows of cans.

Embodiments of the present invention will now be described in more detail below.

DETAILED DESCRIPTION OF THE PREFERRED EMBODIMENTS

Figure 1:
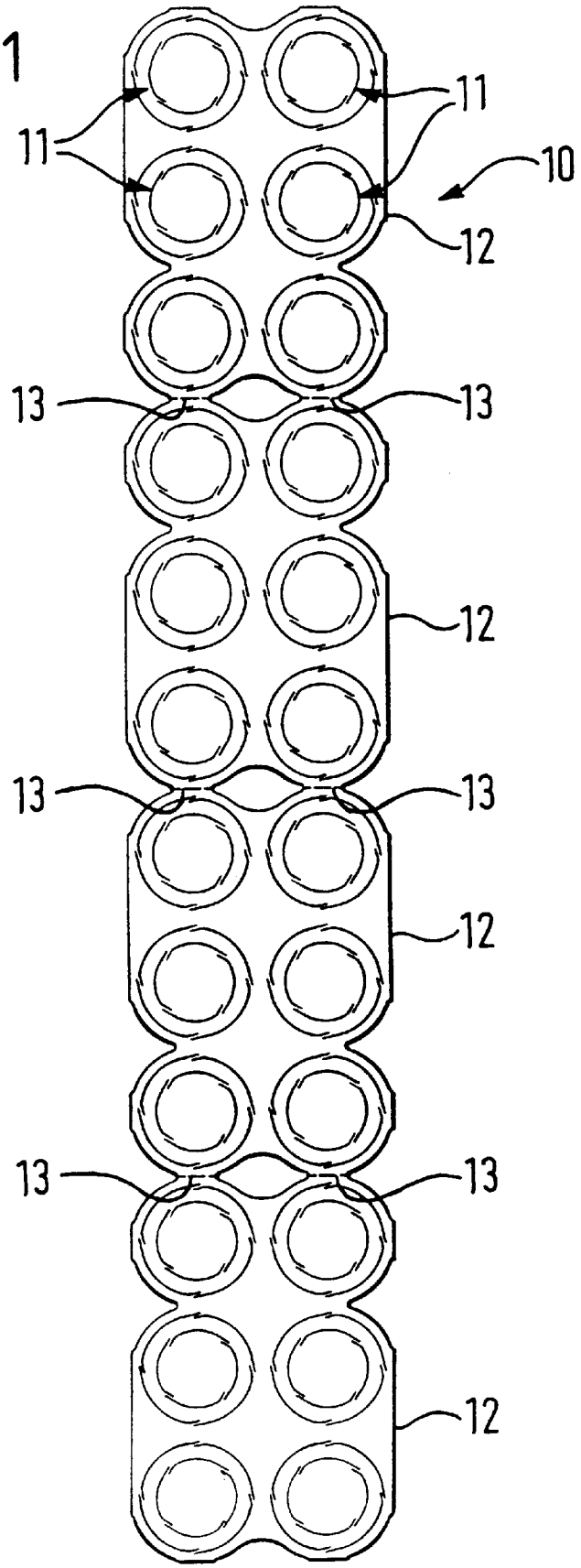
FIG. 1 is a plan view of a first paperboard divider arrangement in accordance with the present invention.

In FIG. 1 there is shown a divider pad arrangement in the form of a strip 10 for disposition between two layers of vertically stacked cans (not shown). The strip 10 provides twenty four seats 11, each of which is positioned between an upper can and a lower can received on opposite sides of the divider, in use. The seats 11 substantially prevent metal to metal contact in the region of the adjoining can tops of the lower cans and the bases of the upper cans. The operation of the actual form of the seats 11, is not relevant to the present invention, and thus in use is not discussed in greater detail. It will be appreciated that other forms of seat 11 can be incorporated, which in its most basic form could be constituted by simple holes defined in the strip. The seats are not necessarily restricted to circular section cans.

When divider pads are used they are stacked individually in a magazine (not illustrated), adjacent a packaging machine (not illustrated). They are taken individually and placed in position on a first layer of lower cans before the upper layer of cans is placed on top of the divider. The twin layer arrangement of cans then proceeds and is wrapped in a carton to form a complete package. As the packaging machines run at great speed, the divider pads have to be positioned accurately on the lower layer of cans. If it is desired to change the size of the multipack from two layers of 2×3 cans to two layers of 2×4 cans, then the stack of divider pads has to be replaced with those of a different size, the magazine has to be adjusted to fit the larger divider pads, and adjustments have to be made to the machine itself so that the larger pads are taken from the magazine and placed accurately on the lower layer of cans. These steps are of course time consuming.

Figure 2:
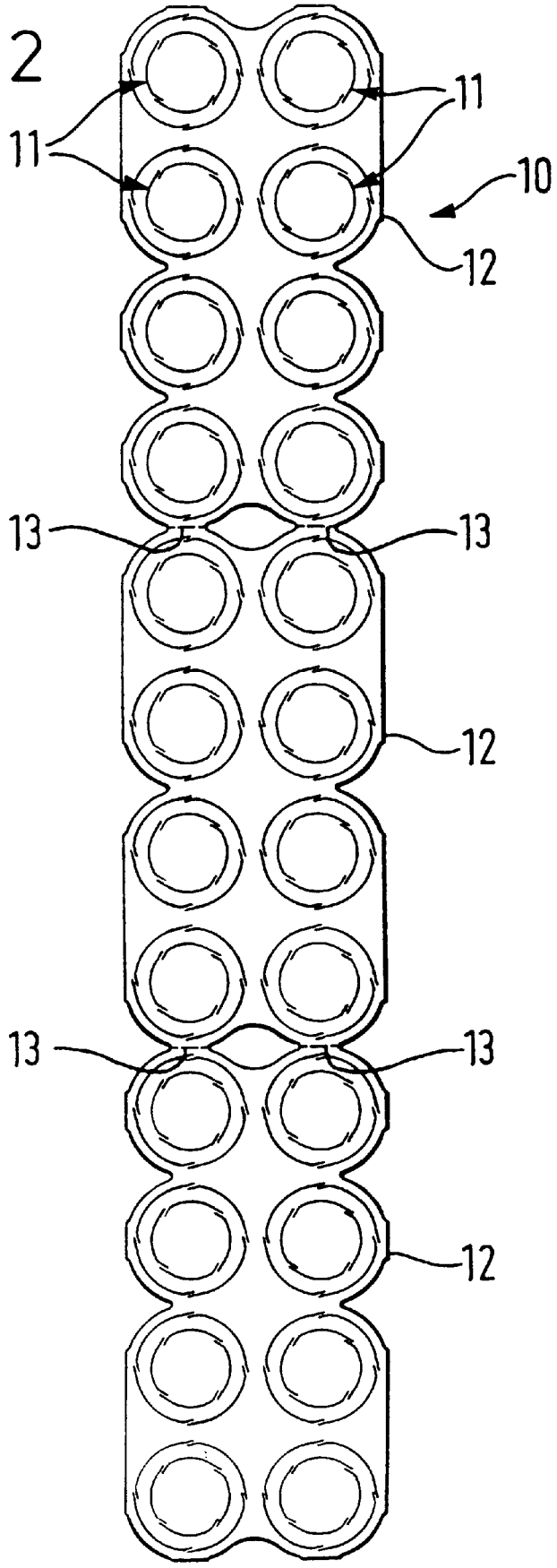
FIG. 2 is a plan view of a second embodiment of a paperboard divider arrangement in accordance with the present invention.
Figure 3:
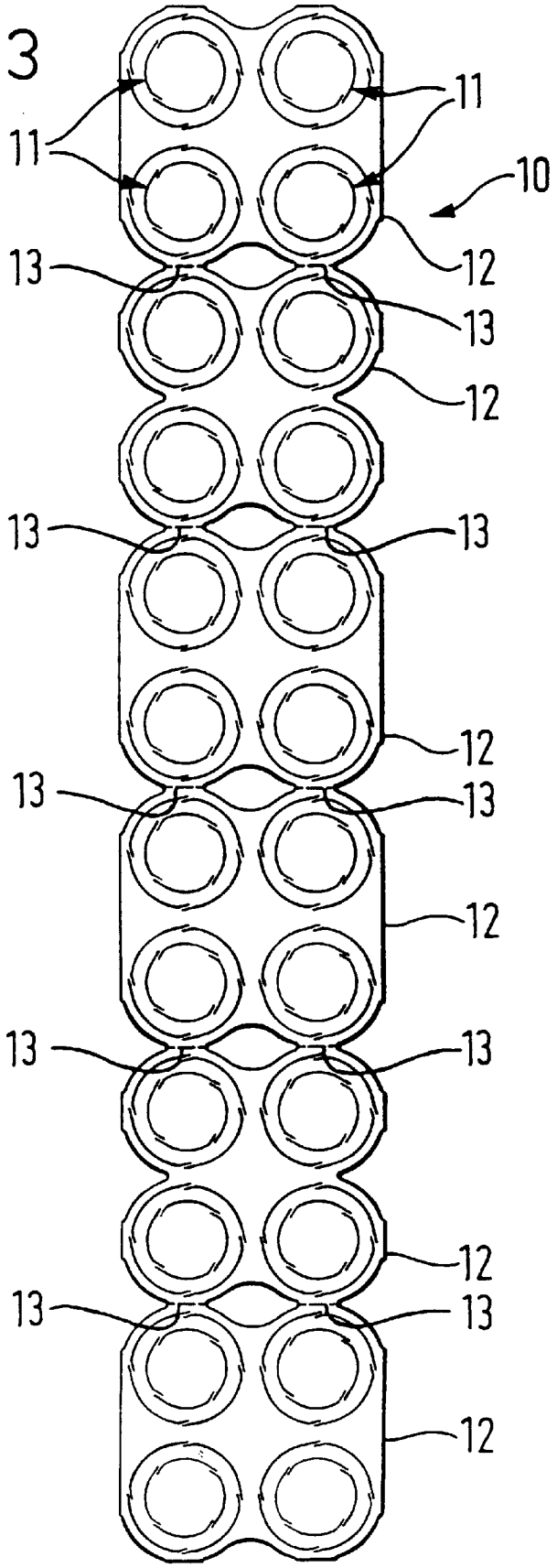
FIG. 3 is a plan view of a third embodiment of a paperboard divider arrangement in accordance with the present invention.

In FIG. 1, the strip 10 comprises four divider pads 12 each having 2×3 seats 11. The pads 12 are joined end to end by lines of weakening 13, such as perforations. In FIG. 2 the strip 10 comprises three divider pads 12 each having 2×4 seats 11. Again the pads 12 are joined end to end by lines of weakening 13. In FIG. 3 the strip 10 comprises six divider pads each having 2×2 seats 11. Again the pads 12 are joined end to end by lines of weakening 13.

With the strips 10 shown in FIGS. 1 to 3 it is not necessary to change the magazine size when changing multipack size, nor is it necessary to adjust the machine itself with regard to placing the pads, because all of the strips 10 are the same length. All that is required is to place the particular strip configuration in the magazine.

The pads are normally placed on the lower cans in an unpitched area of the packaging machine (which may subsequently be unpitched or pitched) where the cans are already formed into two straight rows. By using the strip 10 which is twelve cans long regardless of the size of multipack being made, the mechanism for taking and placing the divider pads can be made to operate at a fixed lower speed on a fixed size of divider pad strip 10. It will be appreciated that the lines of weakening will need to be broken but this will occur automatically in a pitched carton application mechanism and would be a simple procedure in an unpitched machine. Indeed, it has been found that the nesting of the upper can in the top of the lower can may result in sufficient movement of the pad adjacent the lines of weakening in order to separate the pads. In known arrangements, the strip/divider pad placing mechanism has to operate much faster in order to cope with a similar throughput of cans. Clearly this is disadvantageous and reliability can be a problem with a fast operating, various speed mechanism.

It will be appreciated that the strip 10 could be readily adapted for multipacks of other sizes having different numbers of rows. For example single row divider pads, triple row divider pads, and the like are possible. Although the present arrangements are based on a strip 10 which is twelve cans long others will be possible. A strip for twelve cans is, however, convenient due to its divisibility by a range of numbers, i.e. 2, 3, 4, 6 commonly applied to packaging configurations.

The invention also could be applied to continuous forms of divider pads joined by lines of weakening, such as a continuous roll of strips/divider pads, stacked in concertina fashion. Again the strip/divider pad placing equipment can run slower and at a constant speed compared to existing arrangements.

While preferred embodiments of the invention have been disclosed in the foregoing specification, it is understood by those skilled in the art that variations and modifications thereof can be made without departing from the spirit and scope of the invention, as set forth in the following claims. Moreover, the corresponding structures, materials, acts, and equivalents of all means or step plus function elements in the claims are intended to include any structure, material, or acts for performing the functions in combination with other claims elements, as specifically claimed herein.

I claim:

1. A paperboard divider arrangement for separating pairs of vertically stacked cans, each stacked pair of cans having a lower can and a stacked upper can, said divider arrangement comprising:

an elongate paperboard divider strip for being positioned between a predetermined number of pairs of cans along the length of said strip;

wherein said divider strip is formed of a predetermined number of divider pads, each of said divider pads defining a predetermined number of seat areas for receiving the respective upper can thereon, each respective one of said seat areas being disposed between an upper can and a lower can of each of the stacked pairs of cans;

wherein said divider pads are joined at their ends to adjacent ones of said divider pads along perforated score lines in end to end fashion along the length of said strip;

and wherein the predetermined number of pairs of cans divided by said strip is wholly divisible by the numbers 2, 3, and 4.

2. The divider arrangement as claimed in claim 1, wherein the divider pads are sized and shaped to provide said seat areas for at least two spaced rows of cans.

3. The divider arrangement as claimed in claim 1, wherein the divider strip has at least one continuous row of said seat areas twelve seat areas long for receiving a row of twelve cans thereon.

4. The divider arrangement of claim 2, wherein said divider pads are sized and shaped to include three spaced rows of said seats areas for at least three spaced rows of cans.

5. A paperboard divider arrangement for being positioned between and separating pairs of vertically stacked cans, each stacked pair of cans having a lower can including a top and a stacked upper can including a bottom, said divider arrangement comprising:

an elongate paperboard divider strip formed of at least two divider pads extending along the length of said strip;

wherein each of said at least two divider pads has a predetermined number of seat areas defined therein for being singularly received between the top of each lower can and the bottom of each upper can for each respective pair of the pairs of cans;

each of said at least two divider pads having a pair of spaced ends;

said at least two divider pads being joined at their adjacent ends along perforated score lines to adjacent ones of said at least two divider pads end to end along the length of said strip;

and wherein said predetermined number of seat areas of said divider strip is wholly divisible by the numbers 2, 3, and 4.

6. The paperboard divider strip of claim 5, comprising three of said divider panels.

7. The paperboard divider strip of claim 5, comprising four of said divider panels.

8. A paperboard divider arrangement for being positioned between and separating pairs of vertically stacked cans, each stacked pair of cans having a lower can and a stacked upper can, said divider arrangement comprising:

an elongate paperboard divider strip formed of a plurality of divider pads extending along the length of the strip;

wherein each said divider pad has a predetermined number of seat areas defined therein for being inserted between respective upper can of each stacked pair of cans;

wherein each of said divider pads has a pair of spaced ends;

wherein said divider pads are joined together along a spaced series of perforated score lines at their adjacent ends in end to end fashion along the length of said divider strip;

and wherein said predetermined number of seat areas along the length of said divider strip is wholly divisible by the numbers 2, 3, and 4.

9. The paperboard divider strip of claim 8, wherein said plurality of divider pads are formed as a generally continuous roll of said divider panels to form said elongate divider strip.

10. The paperboard divider strip of claim 8, wherein said plurality of divider pads are stacked in concertina fashion to form said elongate divider strip.

* * * * *